US009745813B2

(12) United States Patent
Robertson et al.

(10) Patent No.: US 9,745,813 B2
(45) Date of Patent: Aug. 29, 2017

(54) ANCHOR SYSTEM FOR IMPARTING A ROTATIONAL MOTION IN A CUTTING APPARATUS

(71) Applicant: Robertson Intellectual Properties, LLC, Arlington, TX (US)

(72) Inventors: Michael Robertson, Mansfield, TX (US); Douglas Streibich, Fort Worth, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 289 days.

(21) Appl. No.: 14/727,609

(22) Filed: Jun. 1, 2015

(65) Prior Publication Data

US 2015/0345232 A1 Dec. 3, 2015

Related U.S. Application Data

(60) Provisional application No. 62/006,688, filed on Jun. 2, 2014.

(51) Int. Cl.

| | |
|---|---|
| ***E21B 17/10*** | (2006.01) |
| ***E21B 29/00*** | (2006.01) |
| ***E21B 29/02*** | (2006.01) |

(52) U.S. Cl.

CPC ..... *E21B 29/02* (2013.01); *E21B 17/1078* (2013.01); *E21B 29/002* (2013.01); *E21B 29/005* (2013.01)

(58) Field of Classification Search

CPC .... E21B 29/02; E21B 29/002; E21B 41/0078; E21B 17/1078; E21B 29/005; E21B 43/114; E21B 7/18; B26F 3/004

See application file for complete search history.

(56) References Cited

U.S. PATENT DOCUMENTS

| | | | | |
|---|---|---|---|---|
| 3,547,191 | A * | 12/1970 | Malott | E21B 7/18 166/223 |
| 4,134,453 | A * | 1/1979 | Love | E21B 43/114 166/298 |
| 4,184,430 | A * | 1/1980 | Mock | B26F 3/04 102/307 |
| 4,298,063 | A * | 11/1981 | Regalbuto | E21B 29/02 102/308 |
| 4,598,769 | A | 7/1986 | Robertson | |
| 5,435,394 | A | 7/1995 | Robertson | |
| 2004/0089450 | A1 | 5/2004 | Slade et al. | |

(Continued)

OTHER PUBLICATIONS

International Search Report and Written Opinion regarding corresponding PCT Application No. PCT/US2015/033656, dated Aug. 12, 2015.

(Continued)

*Primary Examiner* — Daniel P Stephenson

(57) ABSTRACT

Systems and methods usable in conduit cutting operations are disclosed. Specifically, an anchor assembly is configured to be attached to a cutting apparatus and to equalize the upward and downward forces on the cutting apparatus during performance of the cutting operation. In addition, the anchor assembly is configured to impart a rotational motion in the cutting apparatus to produce a clean and complete horizontal cut of the conduit at a desired location.

24 Claims, 8 Drawing Sheets

(56) References Cited

U.S. PATENT DOCUMENTS

| | | | | |
|---|---|---|---|---|
| 2006/0086507 | A1* | 4/2006 | Surjaatmadja | E21B 37/00 166/312 |
| 2012/0132469 | A1* | 5/2012 | Robson | E21B 17/1078 175/53 |
| 2014/0034317 | A1* | 2/2014 | Hekelaar | E21B 29/005 166/298 |
| 2015/0345232 | A1* | 12/2015 | Robertson | E21B 29/005 166/298 |
| 2016/0017699 | A1* | 1/2016 | Watson | E21B 43/114 166/298 |

OTHER PUBLICATIONS

Pressure Balance Anchor (PBA) product specification, MCR Oil Tools, http://mcroiltools.com/PRODUCTS/PressureBalanceAnchor/tabid/100/Default.aspx.

* cited by examiner

ANCHOR SYSTEM FOR IMPARTING A ROTATIONAL MOTION IN A CUTTING APPARATUS

CROSS-REFERENCE TO RELATED APPLICATIONS

This is a non-provisional of U.S. Provisional Patent Application Ser. No. 62/006,688, filed Jun. 2, 2014, which is incorporated herein by reference, and to which priority is claimed.

FIELD OF THE INVENTION

The present invention relates to systems and methods usable in wellbore conduit cutting operations. More specifically, the present disclosure relates to an anchoring system for stabilizing a conduit cutting apparatus in a predetermined position and for enabling even and complete cutting of the conduit.

BACKGROUND

During drilling or production of oil and gas wells, it is not uncommon for a string of conduit such as casing, drill pipe, coiled tubing, or other conduit, which is downhole, to become lodged within a wellbore at some point along its length. Therefore, there are devices known in the art which can be lowered into the conduit string, and which, through either chemicals or heat imparted to the conduit wall, can cut the conduit such that the portion of the string above the cut can be retrieved from the wellbore and the "stuck" portion below the cut can be abandoned in the wellbore.

One such device is disclosed in U.S. Pat. No. 4,598,769, entitled "Pipe Cutting Apparatus," by an inventor of the invention described in the present application, Michael Robertson, which patent is incorporated herein by reference. FIG. 1 illustrates a cutting assembly 10 disclosed in the '769 patent. The cutting assembly 10 includes a cutting apparatus 31 (which may be referred to as a "torch") for producing a cutting fluid. Prior to a cutting operation, the cutting assembly 10 is lowered into a wellbore conduit 12 (i.e., a conduit to be cut) using a lowering device such as wireline 20. To initiate a cutting operation, an electric current is produced from the surface of the well and is applied, through electric conductors, to an electrode plug 30, from where it is conducted on to prong 32, conductor 34, spring 36, and squib 38, all positioned within the cutting portion of the cutting apparatus 31. Loosely packed pyrotechnic material 40 contained within the cutting apparatus 31 is ignited by the current, which, in turn, ignites compressed combustible pyrotechnic material 40 that is formed into pellets 42 surrounding the material 40. A cutting fluid that is produced by the ignited material 40 is directed toward the lower end 43 of the cutting apparatus 31. The fluid is then directed to a nozzle assembly 44, comprising a plurality of cutting nozzles 46, each nozzle 46 configured to direct the conduit cutting fluid 48 from the direction along the elongate axis of cutting assembly 10 radially against the interior wall 25 of conduit 12 to produce a cut along cutline 50.

The reaction of the pyrotechnic material generates a large volume of fluid (e.g., gaseous reaction products) within the conduit at the point of the cut. This fluid volume can create forces that act upon the cutting assembly 10. For example, the discharge of the fluid below the cutting assembly 10 (i.e., downhole) generates a thrust that acts to move the cutting apparatus in an upward direction. Because this action occurs during the cutting operation, if the cutting apparatus is not properly anchored, it may produce very uneven, jagged, or incomplete cuts, and, in extreme cases, may be propelled out of the wellbore, causing damage, and perhaps endangering the safety of the workers on the rig floor.

The cutting apparatus disclosed in the '769 patent employs a mechanical anchoring assembly 16 to address these issues. The anchor assembly 16 includes a series of jaws 22, which extend outwardly (phantom view in FIG. 1) from the body 17 of anchor assembly 16 to engage against the interior wall 25 of the conduit 12. This primary anchoring system is activated when the cutting assembly 10 is positioned downhole at the desired depth prior to the cutting operation to assure the stable positioning of the cutting assembly 10. As a secondary anchoring system, there is provided a series of drag springs 26, which engage against the interior wall 25 of the conduit 12, above the jaws 22, for stabilizing the cutting assembly 10 during the cutting operation. Additional details regarding the operation of the cutting apparatus 31 are described in the '769 patent.

There are certain shortcomings associated with the mechanical anchoring assembly 16. For example, the anchors must be set manually and properly prior to operating the cutting apparatus, which requires preliminary preparation within the wellbore prior to the cutting operation. In addition, due to the mechanical nature of the anchor system, the anchors may not set properly, which may result in the above-described cutting and safety concerns. Still further, the anchors may not function at all, which would require the cutting apparatus to be retrieved from the wellbore for service prior to the cutting operation.

To overcome the shortcomings of the disclosed mechanical anchoring system, Robertson disclosed an improved anchoring system in U.S. Pat. No. 5,435,394, entitled "Anchor system for pipe cutting apparatus," which patent is incorporated herein by reference. FIG. 2 illustrates an improved anchor assembly 110 that was disclosed in the '394 patent. Anchor assembly 110 acts to stabilize the cutting apparatus 104 during cutting operations as will be described below. The cutting apparatus 104 functions in a substantially similar way as the cutting apparatus 31 of cutting assembly 10, described above, and as more fully described in the '769 patent. The lower end of the cutting apparatus 104 is modified (as compared to cutting apparatus 31) to accommodate the anchor assembly 110. As illustrated, the anchor assembly 110 includes a substantially cylindrical elongated anchor body 112. In the depicted embodiment, the anchor body 112 is threadably attached to the lower end 113 of the cutting apparatus 104 via a threaded pin 116 that is engaged into a threaded port 118 in both the anchor assembly 110 and the cutting apparatus 104. In other embodiments, different mechanisms (e.g., bolts, pins, etc.) are utilized to couple the cutting apparatus 104 to the anchor assembly 110. The lower end 120 of the anchor body 112 is formed into a conical point 122, which eases the process of lowering the cutting apparatus 104 into the wellbore conduit 12.

The external diameter of the anchor body 112 is shown to be substantially equal to the external diameter of the cutting apparatus 104. Therefore, the annular space 124 formed between the anchor body 112 of the anchor assembly 110 and the interior wall 25 of the conduit 12 is shown to be substantially equal to the annular space 126 between the body of the cutting apparatus 104 and the interior wall 25 of the conduit 12. Further, the overall length of the anchor body 112 may vary; however, it is preferred that the overall length be generally equal to the overall length of the cutting apparatus 104, for reasons to be explained below.

Turning now to the anchoring functions of the anchor body 112, when the firing mechanism of the cutting apparatus 104 has been activated, and the ignitor material 40, 42 is producing the cutting fluid (arrow 48) that extends radially outward from the nozzles 46 to cut the wall 14 of the conduit 12, a great volume or "bubble" of the fluid (illustrated by arrows 140) can be produced. This fluid can flow within the annuli 124, 126 formed between the anchor body 112 and the interior wall 25 of the conduit 12, and between the body of the cutting apparatus 104 and the interior wall 25 of the conduit 12, respectively. Because of its length and diameter, the anchor body 112 defines the annular space 124 between itself and the interior wall 25 of the conduit 12 that is substantially equal to the annular space 126 defined between the body of the cutting apparatus 104 and the interior wall 25 of the conduit 12. Therefore, as fluids travel both upward (arrows 144) and downward (arrows 146), the volume of fluid above the cutline 50 is equal to the volume of fluid below the cutline 50, and is of equal pressure. Therefore, applying Boyle's Law, because the two annuli 124, 126 formed by the body of the cutting apparatus 104 and the body 112 of the anchor assembly 110 are substantially equal, the volumes of the fluid in each of the respective annuli 124, 126 are equal because the pressure of the fluid above the cutline 50 is essentially equal to the pressure of the same fluid below the cutline 50. Thus, the resulting downward forces due to thrust and the pressure of the fluids above the cutline 50 are equal to the upward forces due to thrust and the pressure of the fluids below the cutline 50. The resulting forces on the torch are therefore equalized, which acts to maintain the position of the cutting apparatus 104 relative to the conduit 12.

When the annuli 124, 126 are substantially equal, the lengths of the anchor body 112 and the cutting apparatus 104 should also be substantially equal in order to equalize the volumes in the annuli 124, 126, but this is not always required. What is required is that the resulting volume contained within the upper annulus 126 be equal to the volume contained within the lower annulus 124 such that the upward and downward forces are equalized.

Because the cutting procedure takes place within a time frame of less than a second, the equalization of pressures must be present only during that time to ensure that the cutline 50 is as smooth and straight as possible. Should the fluid volumes eventually change, causing a pressure imbalance after the completion of the cutting operation, the position of the cutting apparatus 104 may shift. However, as long as the cut has been completed, the shifting of the cutting apparatus 104 becomes immaterial. Moreover, the initial high pressures of the fluid, during and immediately following the cut, will have been reduced rather rapidly, thus avoiding any possibility of causing the torch to travel upward at a dangerous speed within the hole.

While the improved anchoring apparatus 110 balances the upward and downward forces on the cutting apparatus 104 such that the axial position of the cutting apparatus 104 within the conduit 12 is maintained for the duration of a cutting operation, there are additional problems associated with the cutting efficiency associated with prior art cutting devices. One common problem associated with prior art conduit cutting devices occurs as a result of the arrangement of multiple discrete nozzles (e.g., nozzles 46) about the cutting apparatus. During cutting operations, as the fluid is expelled from the nozzles, the fluid tends to cut or perforate the conduit wall at a target location directly across the annular gap between the nozzle and the conduit. This cutting action often leaves uncut conduit material between the cut holes or perforations at the target locations, resulting in the conduit remaining intact. This results in the need to deploy another cutting device into the conduit to complete the cutting operation.

Another problem associated with prior art conduit cutting devices is caused by the pivoting or swinging action of the cutting apparatus during cutting operations. Specifically, as the fluid is expelled from the nozzles, slight differences in forces within the annuli 124, 126 caused by the moving fluid may move or pivot the cutting device off its central longitudinal axis. For example, the cutting device may swing side to side, from a wireline, within the conduit that is being cut. Such movements cause the discharged cutting fluid to contact the inner conduit wall above or below the intended target location, resulting in an uneven cut. If the movement of the cutting device is significant, the heat energy of the fluid may be applied to and dissipated over a large surface area of the conduit wall, which may result in an incomplete cut.

Given these shortcomings, the art of oilfield tools, and, specifically, wellbore conduit cutting devices, would benefit from improved methods and apparatus for maintaining the position of a cutting device within a wellbore while also producing safer and more consistent cuts.

DETAILED DESCRIPTION

Disclosed is an improved anchor assembly for performing cutting operations within a wellbore conduit. The anchor assembly operates to impart a rotational motion in an attached cutting apparatus. As set forth below, the disclosed cutting apparatus maintains the beneficial balancing aspects of the prior art anchor assembly described above (i.e., to maintain the axial location of a cutting assembly relative to the conduit being cut) and improves the cutting efficiency that is achieved by the attached cutting apparatus.

Figure 1:
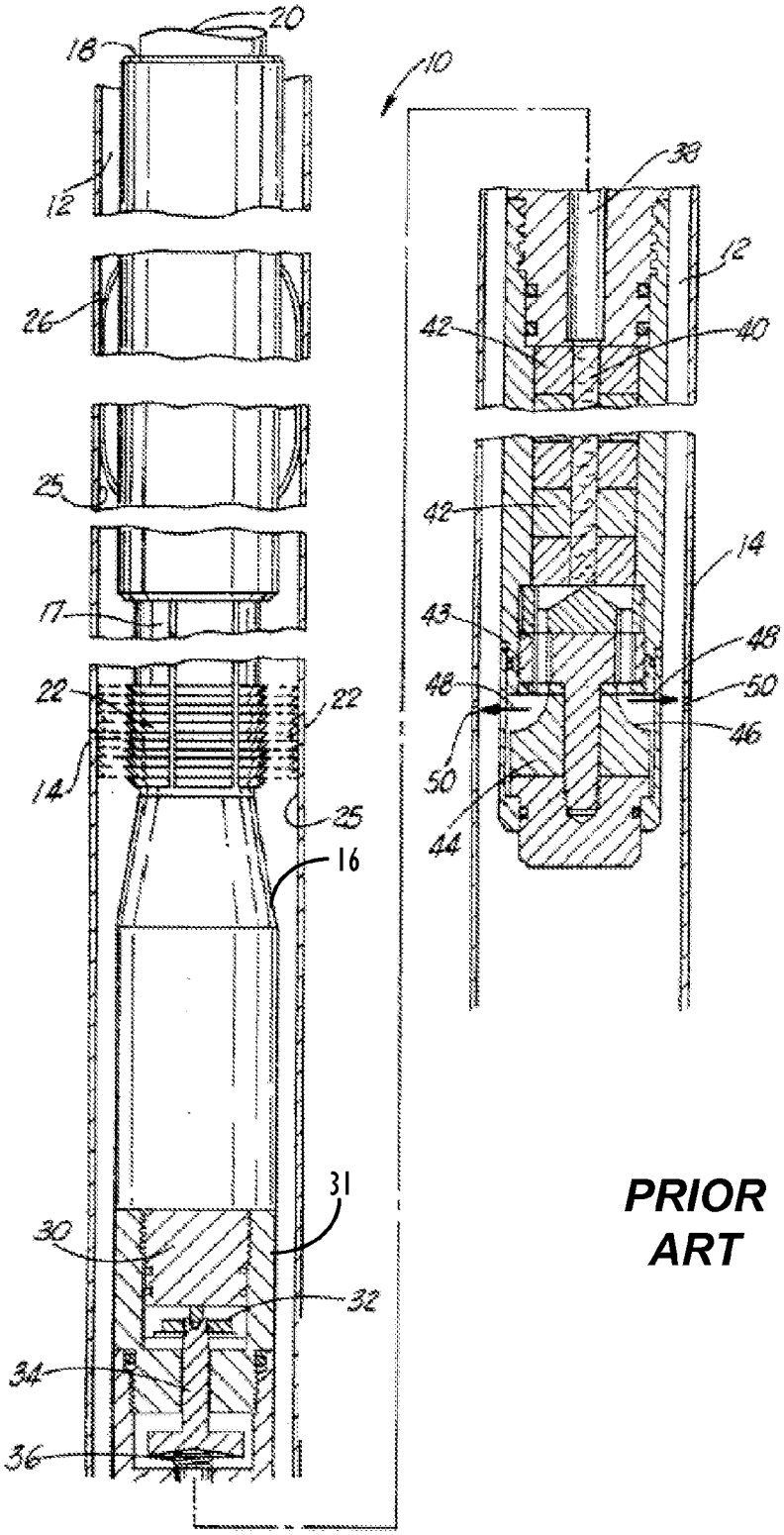
PRIOR ART FIGURE 1
FIG. 1 illustrates a prior art cutting assembly having a cutting apparatus and a mechanical anchor assembly.
Figure 2:
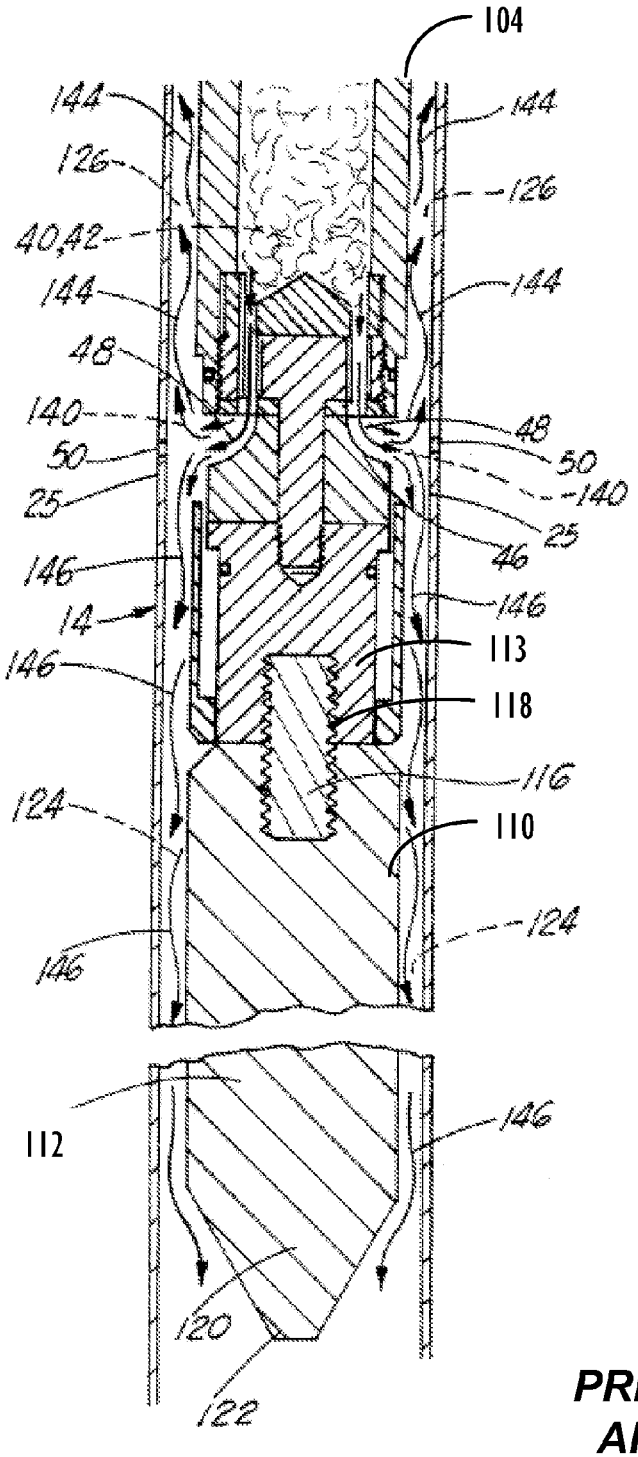
PRIOR ART FIGURE 2
FIG. 2 illustrates a prior art cutting assembly having a cutting apparatus and a balancing anchor assembly.
Figure 3:
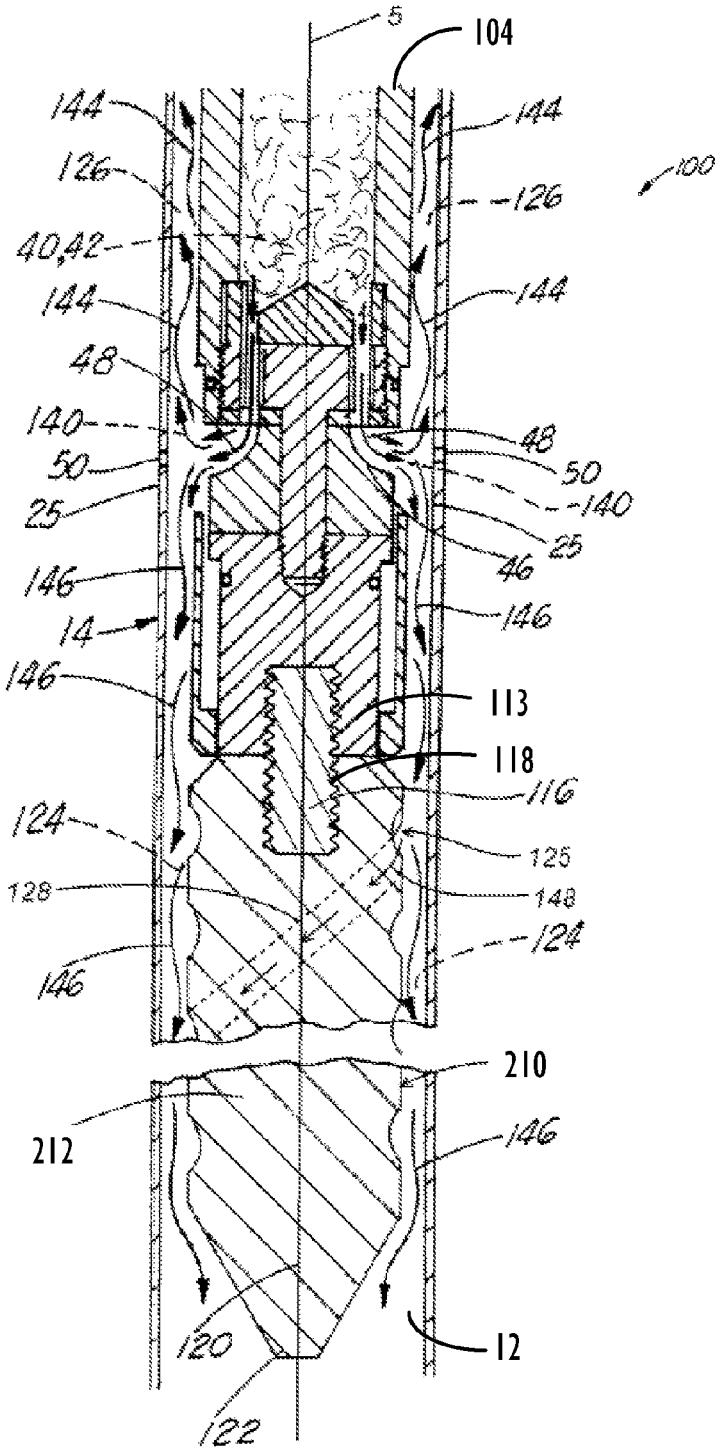
FIG. 3 illustrates a cutting assembly having an anchor assembly in accordance with an embodiment of the disclosure.

Referring to FIG. 3, a modified cutting assembly 100 within the scope of the present disclosure is illustrated. The illustrated embodiment includes the cutting apparatus 104 described above. The cutting apparatus 104 is coupled to a modified anchor assembly 210. Although one embodiment of the anchoring system is described and depicted as being used with the cutting apparatus 104 described herein, other torches, heat cutting devices, chemical cutting devices, etc., are usable with the disclosed anchoring system. Throughout the remainder of the disclosure, the cutting apparatus and the anchor assembly are referred to collectively as a cutting assembly (shown as cutting assembly 100 in FIG. 3).

In the illustrated embodiment, the anchor assembly 210 has one or more features positioned about its body 212. More specifically, the illustrated embodiment includes multiple helical (e.g., spiral) flutes 125 (e.g., channels) extending longitudinally and circumferentially along the surface thereof. While the anchor assembly 210 operates to equalize the forces that act upon the cutting apparatus 104 in the upward and downward directions (i.e., by equalizing the volumes in the annuli 124, 126 in the same manner as the anchor assembly 110 described above), anchor assembly 210 also operates to impart a rotational motion in the cutting assembly 100 around the central longitudinal axis 5. The rotational motion is created by the movement of a fluid (e.g., the gaseous reaction products of the reaction of pyrotechnic material 40, 42) that is discharged by the cutting apparatus 104 during a cutting operation through or along a flow path formed by the helical flutes 125. More specifically, as the fluid moves through the annular space 124 along the direction indicated by the arrows 146, a portion of the fluid enters and moves along or within the flow path created by the helical flutes 125, as indicated by arrows 148. When the fluid enters and moves through or along the flow path created by the helical flutes 125, the fluid changes direction, causing reactionary lateral forces to generate torque about the central longitudinal axis 5 of the cutting assembly 100, which causes the cutting assembly 100 to rotate about the axis 5. Although FIG. 3 depicts fluid moving within a single helical flute 125, it should be understood that the fluid that is discharged from the nozzles can move through all of the flutes within the anchor body 212 of the anchor 210.

In one embodiment, a pivot joint or a rotating swivel (not shown), such as a slip ring swivel, can be used to connect the upper end of the cutting apparatus 104 to a wireline (not shown) used to lower the cutting assembly 100 downhole. The rotating swivel can allow the cutting assembly 100 to rotate without twisting the wireline, while allowing the transmission of power and electrical signals between the wireline and the cutting assembly 100.

During cutting operations, the cutting fluid 48 is directed from each nozzle 46 to contact and cut and/or perforate the conduit 12 at a target point directly across the annular space from the nozzle 46. As described above, in prior art cutting devices, such cutting action often leaves uncut conduit material between the target points, which can result in the conduit remaining intact and the need to deploy an additional cutting apparatus to complete the cutting operation. However, the rotation of the cutting assembly 100 about the axis 5 causes the cutting fluid 48 to be directed toward all points of the interior wall 25 of the conduit 12 that lie in the horizontal cutting plane (i.e., the horizontal plane that intersects the centerline of the fluid impingement from the nozzles 46). That is, the cutting fluid 48 that is discharged from each nozzle 46 rotates about the axis 5 along with the cutting assembly 100 to create a circumferential cutting path.

The rotating action of the cutting assembly 100 additionally stabilizes the cutting assembly 100 by maintaining a constant orientation of the central longitudinal axis 5 of the cutting assembly 100, based on the principles of conservation of angular momentum. Specifically, as the cutting assembly 100 rotates, the cutting assembly 100 becomes more resistant to external torque applied thereto and, therefore, more stable than a nonrotating assembly. Thus, because the cutting assembly 100 is maintained in an orientation essentially along a single axis, namely the central axis 5, the nozzles 46 can direct the cutting fluid 48 along a single horizontal cutting plane. As such, the rotation of the cutting assembly 100 that is caused by the anchor assembly 210 results in a smooth and complete cut along the cutline 50.

In the discussion of the cutting assembly 100, as illustrated in FIG. 3, the cutting assembly 100 has been described with reference to a combustible cutting apparatus 104. However, for purposes of the functioning of the cutting assembly 100, the anchor assembly 210 (as well as each of the anchor assembly embodiments described below) can be utilized whether the cutting assembly 100 comprises a combustible cutting device or a chemical cutting device. The discharge of a fluid would result in a balancing of the forces and rotation of the cutting assembly 100 in either case, as described above. Furthermore, the cutting apparatus 104 can be utilized to cut different types of wellbore conduits such as casing, drill pipe, coiled tubing, pipe subs, etc.

Figure 4A:
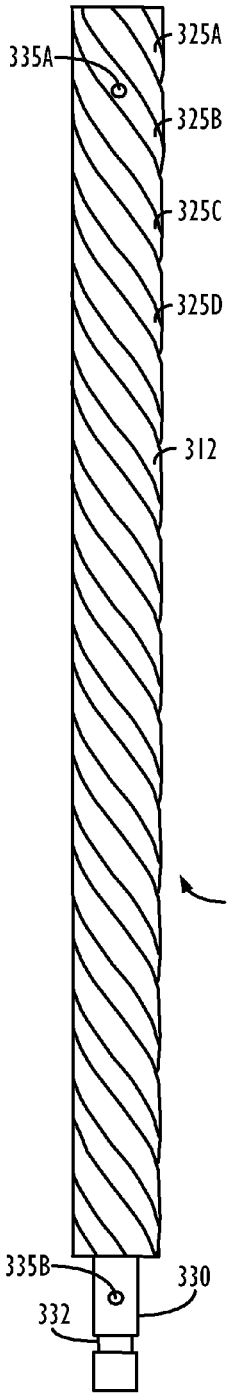
FIGS. 4A-4C illustrate a front view, a vertical cross-sectional view, and a horizontal cross-sectional view, respectively, of an anchor assembly in accordance with an embodiment of the disclosure.
Figure 4B:
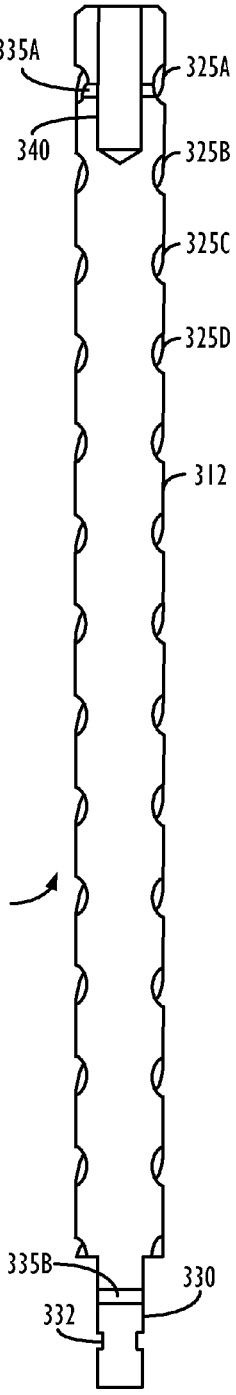
Figure 4C:
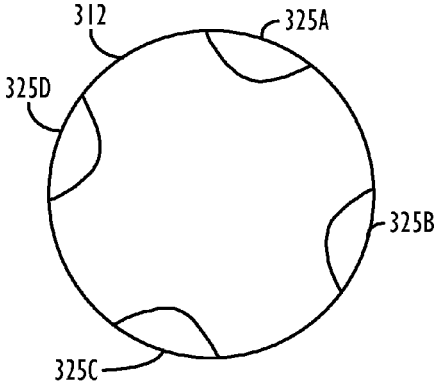

Referring now to FIGS. 4A-4C, another embodiment of an anchor assembly 310 is depicted. The anchor assembly 310 acts to impart a rotational motion to a connected cutting apparatus in the same manner as anchor assembly 210. The anchor assembly 310 is shown comprising a main body portion 312 having an elongated cylindrical shape with four helical flutes 325A-D extending longitudinally and circumferentially along the surface of the body portion 312. Although four helical flutes 325A-D are shown, it should be understood that in other embodiments of the anchor assembly 310, one, two, three, or more helical flutes can be incorporated. The anchor assembly 310 is further depicted comprising an anchor stud 330 extending from the bottom end of the main body portion 312. The anchor stud 330 is shown having a generally cylindrical shape with a circumferential groove 332 extending thereabout. In one embodiment, the circumferential groove 332 can serve to axially align the stud within a cavity 340 of another anchor assembly 310 such that the anchor assemblies can be connected.

The vertical cross-sectional view of the anchor assembly 310 in FIG. 4B illustrates the aperture or cavity 340 for receiving the anchor stud 330. In this way, the anchor stud 330 can be used to connect to another anchor assembly 310, whereby multiple anchor assemblies 310 can be connected in line (e.g., in series), to adjust the length of the anchor assembly (e.g., to provide an appropriate annular volume below the nozzle of the cutting apparatus to balance the axial forces that occur as a result of the fluid discharged during the cutting operation). Specifically, the anchor stud 330 can be inserted into the cavity 340 of another anchor assembly 310 and retained therein by one or more retaining pins or bolts (not shown) inserted through the holes 335A and 335B to connect the two anchor assemblies 310 together. Once two anchor assemblies 310 are assembled with the stud 330 of one anchor assembly 310 inserted into the cavity 340 of another anchor assembly 310, the two anchor assemblies 310 can be rotated or oriented to align the helical flutes 325A-D to maintain the continuity of each flute or channel of the helical flutes 325A-D of the two anchor assemblies 310. In one embodiment, alignment of the holes 335A and 335B serves to align the helical flutes 325A-D of the adjoining anchor assemblies 310. In one embodiment, the holes 335A and 335B may be threaded to receive a threaded retaining pin or bolt.

Figure 8:
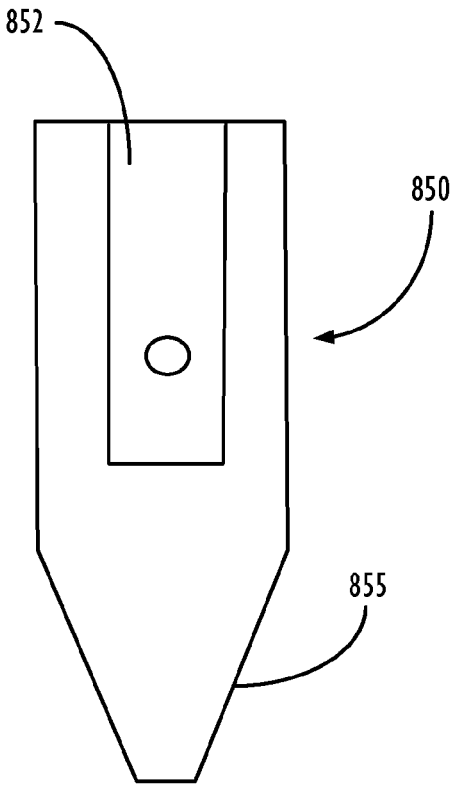
FIG. 8 illustrates a bull plug in accordance with an embodiment of the disclosure.

The anchor stud 330 can further be used to connect a bull plug 850, as shown in FIG. 8, to the bottom end of the anchor assembly 310. The bull plug can have a conical bottom portion 855 and upper cavity 852 usable to receive the anchor stud 330 in the same manner described regarding the connection of anchor assemblies 310. The conical bottom portion 855 of the bull plug 850 can enable easier insertion of the cutting assembly into a conduit to be cut.

Although the anchor assembly 310 is depicted in FIG. 4A as having an anchor stud 330 and a cavity 340 usable to connect to another anchor assembly 310, in another embodiment, the anchor assembly 310 can include any means or combination of connectors usable to connect to another anchor assembly 310. For example, the anchor assembly 310 can comprise one or more threaded cavities (not shown) for receiving a threaded pin 116 (see FIG. 3), allowing the anchor assembly 310 to be connected with the lower end 113 of the cutting apparatus 104 as well as to another anchor assembly 310.

The horizontal cross-sectional view of the anchor assembly 310 in FIG. 4C illustrates the position of the flutes 325A-D about the body 312. It will be understood that different rotational properties (e.g., rotational speed, etc.) can be obtained by altering the geometry and the pitch of the helical flutes 325A-D.

Figure 5A:
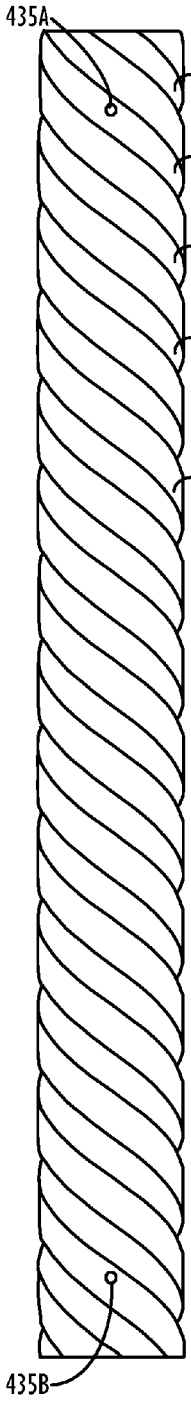
FIGS. 5A-5C illustrate a front view, a vertical cross-sectional view, and a horizontal cross-sectional view, respectively, of an anchor assembly in accordance with an embodiment of the disclosure.
Figure 5B:
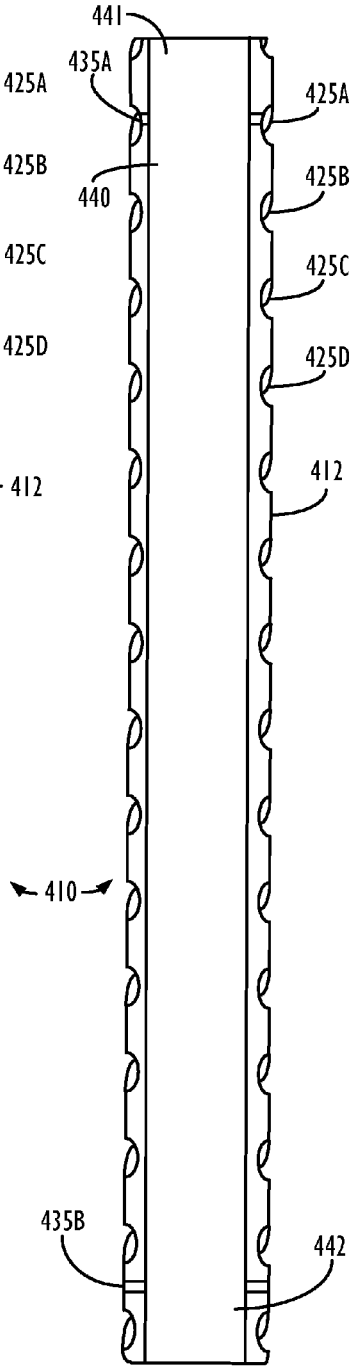
Figure 5C:
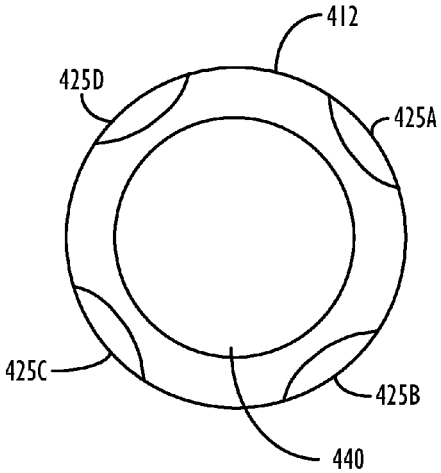
Figure 9:
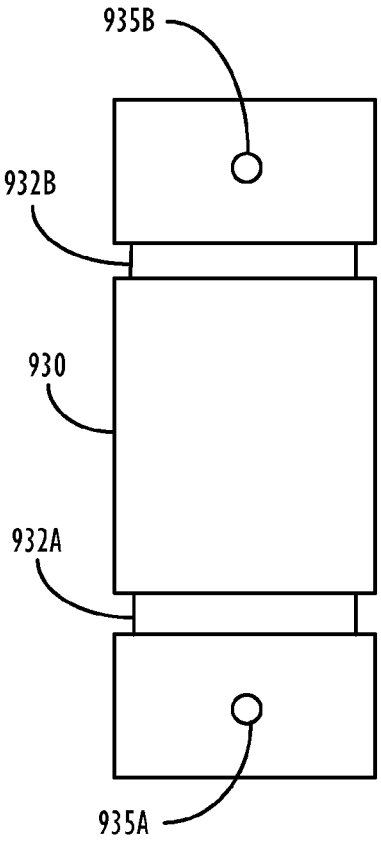
FIG. 9 illustrates a double stud connector in accordance with an embodiment of the disclosure.

Referring now to FIGS. 5A-5C, another embodiment of an anchor assembly 410 is depicted. The anchor assembly 410 acts to impart a rotational motion to a connected cutting apparatus in the same manner as anchor assemblies 210 and 310. The anchor assembly 410 is shown comprising a main body portion 412 having an elongated tubular configuration with four helical flutes 425A-D extending longitudinally and circumferentially along the surface of the main body 412. The vertical cross-sectional view of the anchor assembly 410 in FIG. 5B illustrates an axial bore 440 that extends along a central longitudinal axis through the body 412 of the anchor assembly 410. The axial bore 440 enables the anchor body 412 to have a larger outer diameter, which allows an attached cutting apparatus to be used to cut large diameter conduit, while reducing the overall weight of the cutting assembly. Two or more anchor assemblies 410 can be connected in line by using a double stud 930 as illustrated in FIG. 9. The double stud 930 includes circumferential grooves 932A and 932B that can be used to axially align the studs within the axial bores 440 of adjoining anchor assemblies 410. The ends of the double stud 430 are received in an upper end 441 and a lower end 442 of the axial bore 440 of the anchor assemblies 410. Once the two anchor assemblies 410 are assembled with the double stud 430 therebetween, the two anchor assemblies 410 can be rotated or oriented to align the helical flutes 425A-D to maintain the continuity of each flute or channel of the helical flutes 425A-D of the two anchor assemblies 410. One or more retaining pins or bolts (not shown) can be inserted through the holes 435A and 935A and the holes 435B and 935B to retain the double stud 430 within the axial bore 440 for connecting and locking the two anchor assemblies 410 together. In one embodiment, alignment of corresponding holes (435A/935A and 435B/935B) of the anchor assembly 410 and the double stud 930 results in the alignment of the flutes 425A-D of the adjoining anchor assemblies 410. In one embodiment, the holes 435A, 435B and 935A, 935B may be threaded to receive a threaded retaining pin or bolt. Although a single embodiment of the double stud 930 is shown, other connectors usable to connect two anchor assemblies 410 are within the scope of the present disclosure. In addition, a modified version of the bull plug 850 (e.g., modified to contain a portion to be inserted within the axial bore 440) can be utilized to couple the modified bull plug to the furthest downhole anchor assembly 410 in a cutting assembly.

The horizontal cross-sectional view of the anchor assembly 410 in FIG. 5C illustrates the position of the flutes 425A-D about the body 412 as well as the position of the axial bore 440. It will be understood that different rotational properties (e.g., rotational speed, etc.) can be obtained by altering the geometry and the pitch of the helical flutes 425A-D.

Figure 6A:
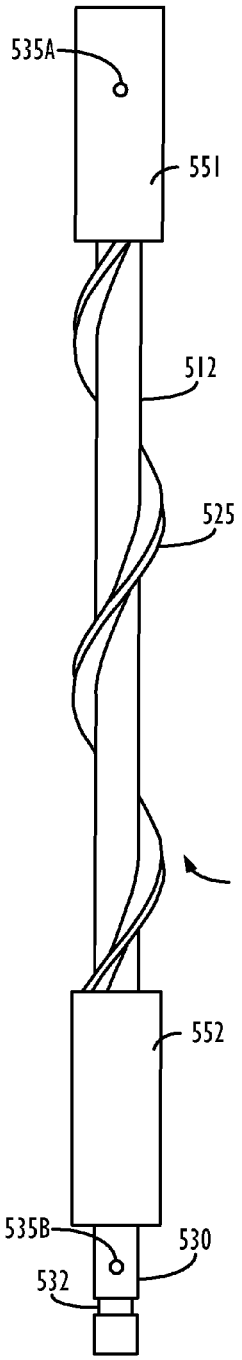
FIGS. 6A-6C illustrate a front view, a vertical cross-sectional view, and a horizontal cross-sectional view, respectively, of an anchor assembly in accordance with an embodiment of the disclosure.
Figure 6B:
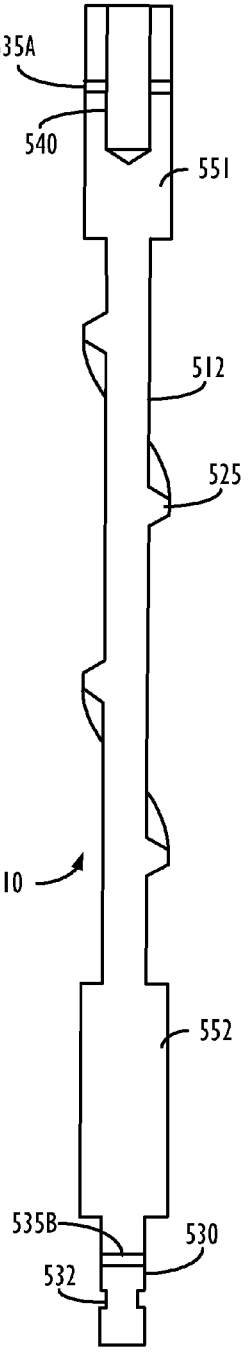
Figure 6C:
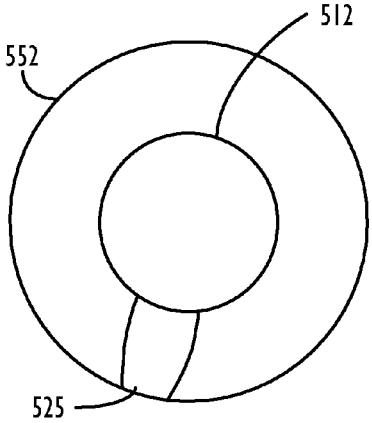

Referring now to FIGS. 6A-6C, another embodiment of an anchor assembly 510 is depicted. The anchor assembly 510 acts to impart a rotational motion to a connected cutting apparatus in the same manner as anchor assemblies 210, 310, and 410. The anchor assembly 510 is shown comprising a main body portion 512 having an elongated cylindrical configuration with a helical vane 525 extending longitudinally and circumferentially along the surface of the body portion 512. The helical vane differs from the helical flutes of the previously-described anchor assemblies in that the vane protrudes from the body whereas the flutes are grooves that are cut into the body of the anchor assembly. While the vanes and flutes may be utilized to provide different rotational properties, the helical vanes and helical flutes both function to direct the flow of fluid in order to impart a rotational motion in a cutting apparatus attached to the anchor assembly. Specifically, during cutting operations, when a fluid that is discharged from the cutting apparatus enters and moves through the lower annular area 124 (see FIG. 3), the fluid contacts the helical vane 525 and changes direction, causing reactionary lateral forces to generate torque about the central longitudinal axis 5 (see FIG. 3) of the cutting assembly, causing the cutting assembly to rotate about the axis 5. Although a single helical vane 525 is shown, it should be understood that in other embodiments of the anchor assembly 510, two, three, four, or more helical vanes can be incorporated. The anchor assembly 510 is further depicted comprising an upper guide portion 551, a lower guide portion 552, and an anchor stud 530 extending from the lower end of the lower guide portion 552. The guide portions 551, 552 have generally cylindrical configurations and act to centralize the anchor assembly 510 within the conduit 12 and to equalize the volume of the lower annulus 124 (see FIG. 3) with the volume of the upper annulus 126 (see FIG. 3) to balance or maintain equal pressures above and below the nozzles 146 (see FIG. 3), as described above.

The vertical cross-sectional view of the anchor assembly 510 in FIG. 6B illustrates an aperture or a cavity 540 for receiving the anchor stud 530. The anchor stud 530 can be used to connect to another anchor assembly 510, whereby multiple anchor assemblies 510 can be connected in line (e.g., in series), to adjust the length of the anchor assemblies (e.g., to provide an appropriate annular volume below the nozzle of the cutting apparatus to balance the axial forces that occur as a result of the fluid discharged during the cutting operation). Specifically, the anchor stud 530 can be inserted into the cavity 540 of another anchor assembly 510 and retained therein by one or more retaining pins or bolts (not shown) inserted through the holes 535A and 535B to connect the two anchor assemblies 510 together. In one embodiment, the holes 535A and 535B may be threaded to receive a threaded retaining pin or bolt.

Although the anchor assembly 510 is depicted in FIG. 6A as having an anchor stud 530 and a cavity 540 usable to connect to another anchor assembly 510, in another embodiment, the anchor assembly 510 can include any means or combination of connectors usable to connect to another anchor assembly 510 or to a cutting apparatus. For example, the anchor assembly 510 can comprise a threaded cavity (not shown) for receiving a threaded pin 116 (see FIG. 3), allowing the anchor assembly 510 to be connected with the lower end 113 of the cutting apparatus 104 as well as to another anchor assembly 510. The anchor stud 530 can further be used to connect a bull plug 850, as shown in FIG. 8, to the bottom end of the anchor assembly 510 as described above.

The horizontal cross-sectional view of the anchor assembly 510 in FIG. 6C shows the position of the vane 525 as viewed looking down the longitudinal axis of the anchor assembly 510 at a point just above the lower guide portion 552. FIG. 6C illustrates the position of the vane 525 relative to the body 512 and the lower guide portion 552. It will be understood that different rotational properties (e.g., rotational speed, etc.) can be obtained by altering the geometry and the pitch of the vane 525.

Figure 7A:
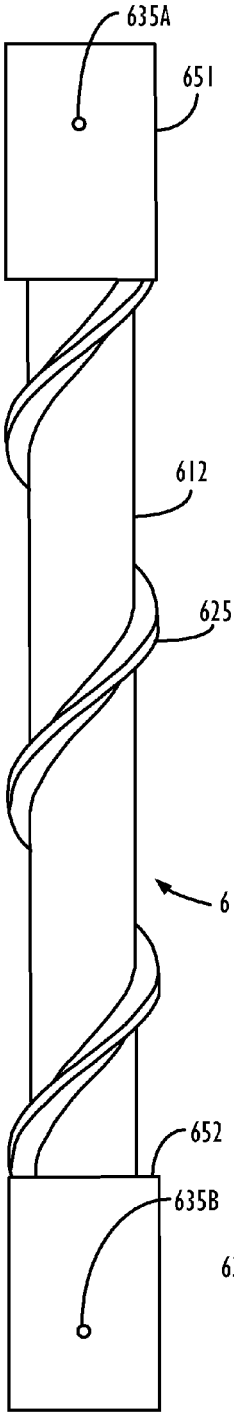
FIGS. 7A-7C illustrate a front view, a vertical cross-sectional view, and a horizontal cross-sectional view, respectively, of an anchor assembly in accordance with an embodiment of the disclosure.
Figure 7B:
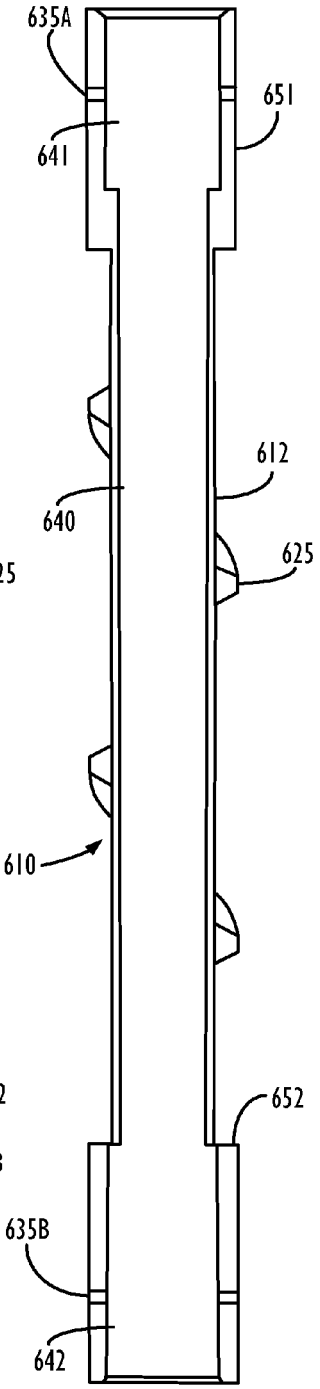
Figure 7C:
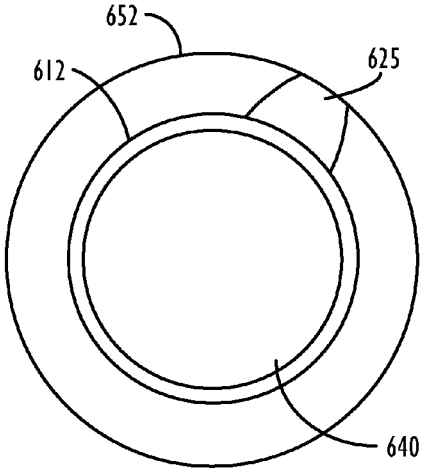

Referring now to FIGS. 7A-7C, another embodiment of an anchor assembly 610 is depicted. The anchor assembly 610 acts to impart a rotational motion to a connected cutting apparatus in the same manner as anchor assemblies 210, 310, 410, and 510. The anchor assembly 610 is shown comprising a main body portion 612 having an elongated tubular configuration with a helical vane 625 extending longitudinally and circumferentially along the surface of the body portion 612. The anchor assembly 610 is further depicted comprising an upper guide portion 651 and a lower guide portion 652. The guide portions 651, 652 have generally cylindrical configurations and act to centralize the anchor assembly 610 within the conduit 12 and to equalize the volume of the lower annulus 124 (see FIG. 3) with the volume of the upper annulus 126 (see FIG. 3) to balance or maintain equal pressures above and below the nozzles 146 (see FIG. 3).

The vertical cross-sectional view of the anchor assembly 610 in FIG. 7B illustrates an axial bore 640 that extends along a central longitudinal axis through the body 612 of the anchor assembly 610. The axial bore 640 enables the anchor body 612 to have a larger outer diameter, which allows an attached cutting apparatus to be used to cut large diameter conduit, while reducing the overall weight of the cutting assembly. A double stud 930 (shown in FIG. 9) can be used to connect two anchor assemblies 610 in the same manner as described above with respect to the connection of anchor assemblies 410. The ends of the double stud 930 are received in an upper end 641 and a lower end 642 of the axial bore 640 of the anchor assemblies 610. One or more retaining pins or bolts (not shown) can be inserted through the holes 635A and 935A and the holes 635B and 935B to retain the double stud 930 within the axial bore 640 for connecting and locking the two anchor assemblies 610 together. In one embodiment, the holes 635A, 635B and 935A, 935B may be threaded to receive a threaded retaining pin or bolt. Although a single embodiment of the double stud 930 is described, other connectors usable to connect two anchor assemblies 610 in line are within the scope of the present disclosure.

The horizontal cross-sectional view of the anchor assembly 610 in FIG. 7C shows the position of the vane 625 as viewed looking down the longitudinal axis of the anchor assembly 610 at a point just above the lower guide portion 652. FIG. 7C illustrates the position of the vane 625 relative to the body 612, the lower guide portion 652, and the axial bore 640. It will be understood that different rotational properties (e.g., rotational speed, etc.) can be obtained by altering the geometry and the pitch of the vane 625.

The ability to easily connect the anchors assemblies (310, 410, 510, and 610), as set forth above, enables the anchor assemblies to be stored and shipped individually, and then later assembled for use. Moreover, the same components that have been described regarding the connection of adjoining anchor assemblies can also be utilized to connect the anchor assemblies to the cutting apparatus. For example, a cutting apparatus may be configured with a protruding member (e.g., a stud) that is capable of being received within a cavity of an anchor assembly (e.g., cavity 340 or 540) and secured by a retaining mechanism that is inserted through holes in the protruding member and the anchor assembly. A cutting apparatus may also be configured with a bore at its lower end to receive a double stud (e.g., double stud 930) for connecting the cutting apparatus to an anchor assembly having an axial bore (e.g., anchor assembly 410 or 610) and secured by a retaining mechanism that is inserted through holes in double stud and the anchor assembly.

As will be understood, each of the disclosed anchor assemblies can be coupled to one or more additional anchor assemblies as well as to a cutting apparatus to create a cutting assembly having the desired properties for performing a specific conduit cutting operation. The cutting assembly can then be deployed into a wellbore and into the wellbore conduit to be cut (e.g., by lowering the cutting assembly into the wellbore via wireline). When the cutting assembly is positioned at the desired depth, the cutting apparatus can then be actuated as described above. The anchor assemblies described herein will act to rotate the cutting assembly about its longitudinal axis, which will result in a clean cut of the conduit at the desired location. After the cutting operation is completed, the cutting assembly and the portion of the conduit above the cut line can be retrieved from the wellbore.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. Thus, the present invention is intended to cover alternatives, modifications, and equivalents that may fall within the spirit and scope of the present invention as defined by the claims.

What is claimed is:

1. An anchor assembly for a downhole cutting apparatus, wherein the anchor assembly comprises:

an anchor body configured to attach to the downhole cutting apparatus, wherein the downhole cutting apparatus is configured to discharge a cutting fluid for perforating or cutting a conduit within a wellbore;

one or more channels extending longitudinally and circumferentially along the surface of the anchor body to form at least one flow path for a portion of the cutting fluid, wherein the at least one flow path imparts a rotational motion in the downhole cutting apparatus when the portion of the cutting fluid discharged by the downhole cutting apparatus flows through or along the at least one flow path formed by the one or more channels.

2. The anchor assembly of claim 1, wherein the one or more channels comprise one or more flutes arranged in a helical pattern around the body.

3. The anchor assembly of claim 1, wherein the one or more channels comprise one or more vanes arranged in a helical pattern around the body.

4. The anchor assembly of claim 1, wherein the anchor body of the anchor assembly comprises a first cavity at a first end and a first stud at a second end.

5. The anchor assembly of claim 4, wherein the first cavity is configured to receive a protruding member of the downhole cutting apparatus for attaching the anchor assembly to the downhole cutting apparatus.

6. The anchor assembly of claim 4, wherein the first stud is configured to be inserted into a second cavity of a second anchor assembly for connecting the anchor assembly to the second anchor assembly.

7. The anchor assembly of claim 1, wherein the anchor body of the anchor assembly comprises an axial bore along its central longitudinal axis.

8. The anchor assembly of claim 1, wherein the rotation of the downhole cutting apparatus about a central longitudinal axis creates a continuous circumferential cutting path along the conduit and improves cutting efficiency.

9. The anchor assembly of claim 1, wherein the anchor assembly equalizes forces acting on the downhole cutting apparatus by equalizing volumes of fluid flowing in annuli to maintain a desired location of the downhole cutting apparatus within the wellbore.

10. A cutting assembly, comprising:

a cutting apparatus comprising one or more nozzles configured to discharge a cutting fluid toward a conduit within a wellbore, wherein the discharged cutting fluid perforates or cuts the conduit; and an anchor assembly connected to the cutting apparatus, wherein the anchor assembly comprises one or more channels forming at least one flow path, wherein a portion of the discharged cutting fluid flows through and along the at least one flow path to impart a rotational motion in the cutting apparatus, wherein the rotation motion in the cutting apparatus forms a circumferential cut or perforation.

11. The cutting assembly of claim 10, wherein the nozzle is configured to direct the fluid radially outward toward a wall of the wellbore conduit.

12. The cutting assembly of claim 11, wherein the discharged cutting fluid comprises a molten thermite.

13. The cutting assembly of claim 10, wherein the one or more channels comprise one or more flutes arranged in a helical pattern.

14. The cutting assembly of claim 10, wherein the one or more channels comprise one or more vanes arranged in a helical pattern.

15. The cutting assembly of claim 10, wherein a body of the anchor assembly comprises a first cavity at a first end and a first stud at a second end.

16. The cutting assembly of claim 15, wherein the first cavity is configured to receive a protruding member of the cutting apparatus for connecting the anchor assembly to the cutting apparatus.

17. The cutting assembly of claim 15, wherein the first stud is configured to be inserted in a second cavity of a second anchor assembly for connecting the anchor assembly to the second anchor assembly.

18. The cutting assembly of claim 10, wherein a body of the anchor assembly comprises an axial bore along its central longitudinal axis.

19. The cutting assembly of claim 10, wherein the anchor assembly is sized to define an annular volume below a nozzle of the cutting apparatus that equalizes upward and downward forces exerted on the cutting assembly during operation of the cutting apparatus.

20. A method for perforating or cutting a conduit within a wellbore, comprising:

providing an anchor assembly comprising one or more channels extending longitudinally and circumferentially along the surface of the anchor assembly to form at least one flow path;

connecting a cutting apparatus comprising one or more nozzles to the anchor assembly to create a cutting assembly;

deploying the cutting assembly into the conduit; and actuating the cutting apparatus to discharge a cutting fluid, wherein the one or more nozzles direct the discharged cutting fluid toward the conduit, and wherein a portion of the discharged cutting fluid flows through or along the at least one flow path to impart a rotational motion to the cutting apparatus to form a circumferential perforation or cut in the conduit.

21. The method of claim 20, wherein the act of actuating the cutting apparatus comprises generating an electrical signal that is conducted to the cutting assembly to ignite the cutting fluid.

22. The method of claim 21, wherein the cutting fluid comprises thermite.

23. The method of claim 20, wherein the act of connecting the cutting apparatus and the anchor assembly comprises:

inserting a stud at a lower end of the cutting apparatus into a cavity at an upper end of the anchor assembly; and inserting a retaining apparatus through holes in the anchor assembly and the stud to maintain the stud within the cavity.

24. The method of claim 20, wherein the rotational motion of the cutting apparatus is generated by or is caused by a change in direction of the portion of the cutting fluid when contacting the one or more channels, which causes a reactionary lateral force to generate torque about a central longitudinal axis of the cutting apparatus, whereby the cutting apparatus rotates about its central longitudinal axis.

* * * * *